US006128841A

United States Patent [19]

Werner

[11] Patent Number: 6,128,841

[45] Date of Patent: Oct. 10, 2000

[54] DRIVE MECHANISM FOR PICTURN SIGN

[76] Inventor: Paul H. Werner, 12301 E. McNichols, Detroit, Mich. 48205

[21] Appl. No.: 09/170,443

[22] Filed: Oct. 13, 1998

[51] Int. Cl.[7] ..... G09F 11/02

[52] U.S. Cl. ..... 40/505; 40/503

[58] Field of Search ..... 40/503, 504, 505, 40/506, 507; 74/436, 526, 665 F

[56] References Cited

U.S. PATENT DOCUMENTS

| | | | |
|---|---|---|---|
| 1,077,885 | 11/1913 | La Pearl | 40/505 |
| 1,256,645 | 2/1918 | Barnett | 40/505 |
| 1,399,409 | 12/1921 | Sleder . | |
| 1,650,059 | 11/1927 | Bartolomucci | 40/505 |
| 1,785,204 | 12/1930 | Nelson et al. . | |
| 3,273,271 | 9/1966 | Werner . | |
| 3,304,638 | 2/1967 | Grandell et al. | 40/505 |
| 3,387,394 | 6/1968 | Werner . | |
| 4,021,946 | 5/1977 | Bradshaw . | |
| 4,064,502 | 12/1977 | Saylor et al. . | |
| 4,638,580 | 1/1987 | Giannetti et al. | 40/503 |
| 4,983,949 | 1/1991 | Wicker . | |
| 5,255,463 | 10/1993 | Werner | 40/505 |
| 5,255,465 | 10/1993 | Perez | 40/505 |
| 5,343,645 | 9/1994 | Huber | 40/505 |
| 5,412,893 | 5/1995 | Aiken, Sr. | 40/518 |
| 5,511,330 | 4/1996 | Havens | 40/505 |

FOREIGN PATENT DOCUMENTS

| | | | |
|---|---|---|---|
| 2235328 | 2/1991 | United Kingdom | 40/505 |

*Primary Examiner*—Brian K. Green

*Attorney, Agent, or Firm*—Gifford, Krass, Groh, Sprinkle, Anderson & Citkowski, P.C.

[57] ABSTRACT

A rotating sign assembly has a plurality of rotatable, multi-sided, sign segments and a drive mechanism for rotatably driving the sign segments. The drive mechanism includes a drive shaft and one or more output shafts that each operate to rotate a multi-sided sign segment. A cam is fitted to each of the output shafts so that rotation of the cam causes rotation of the corresponding output shaft and sign segment. The cam has an outer perimeter and multiple equally spaced engagement slots which extend radially inwardly from the outer perimeter. Outwardly facing stabilizing portions are positioned between each of the engagement slots. The cam has multiple dwell positions, each corresponding to the display of one side of the multi-sided sign segment operated by the corresponding output shaft. A cam driver assembly is fitted to the drive shaft so that it rotates with the drive shaft. The cam driver assembly has a cam driver which extends outwardly from the axis of rotation and terminates in a knob. The knob describes an arc as the cam driver is rotated about the axis of rotation. The cam driver is configured to engage one of the engagement slots when the cam is in a dwell position and to rotate the cam to another dwell position as the cam driver assembly is rotated about its axis of rotation. The cam driver assembly also includes a stabilizing member which is configured to engage one of the stabilizing portions of the cam when the cam is in a dwell position.

15 Claims, 3 Drawing Sheets

DRIVE MECHANISM FOR PICTURN SIGN

FIELD OF THE INVENTION

The present invention relates generally to rotating sign assemblies and, more particularly, to a rotating sign assembly incorporating an output cam driven by a cam driver assembly to allow rotation of the output cam in set increments.

BACKGROUND OF THE INVENTION

Roadside signs have long been effective means for advertising and conveying messages. Known billboard style signs are advantageous in that they successfully advertise a message to a broad audience for a relatively low price. However, these signs suffer from a severe disadvantage in that their display message may be posted for weeks or months limiting their effectiveness over the long term. The viewing audience simply becomes bored with the same inanimate sign displaying the same message, and its marketing effectiveness drops off significantly over time.

In response to conventional forms of billboard advertising, multi-sided, segmented, rotating signs were developed. These signs typically comprise a number of three-sided sign segments driven by a motor that selectively starts and stops or by a motor having some type of trip mechanism or clutch. One example of this type of sign is disclosed in U.S. Pat. No. 3,387,394.

The old approaches to multi-sided, segmented, rotating signs have several disadvantages. In order for the signs to properly display the message contained on one side of the segments, all of the segments must be precisely aligned. This requires that the mechanism controlling the position of the segments be precisely controlled. This can be accomplished by using some type of feedback position sensor that precisely controls the drive mechanism. However, this approach can be complex and costly and may require periodic adjustment or maintenance to maintain its proper operation. Therefore, there is a need for a drive mechanism that eliminates the need for such precise control and is simple, inexpensive, and durable.

It is also desirable that the multi-sided segments be held securely in position while displaying each message. Gear and cam driven drive mechanisms often have slop or compliance that increases with wear. If slop or compliance develops in the system, the multiple segments may develop an uneven appearance detracting from the aesthetics and effectiveness of the sign. Therefore, it is desirable that a drive mechanism for a multi-sided, segmented, rotating sign include means to securely hold the segments in a display position between rotational movements.

In traditional multi-sided, segmented, rotating sign assemblies, each of the segments rotates to a new display position at the same time. This creates the appearance of a quick and uniform fade from one advertising message to another. However, for some applications it is desirable that some of the sign segments rotate before other segments so that the appearance of a change sweeping from one portion of the sign to another can be created. Therefore, there is a need for a simple system which allows for sequential rotation of sign segments so as to create enhanced visual effects. However, these enhanced visual effects may only be desirable with certain advertising messages. As different advertising is substituted on the various sides of the multi-sided sign, it may be desirable to change the sequentially changing sign to a traditional uniformly fading sign. Therefore it is desirable that a drive mechanism provide for adjustability so that the same sign can be changed from providing a uniform fade from one message to another to providing a sweeping fade. It is especially desirable that such changes or adjustments be possible in a simple manner for signs that are already installed, such as along a highway.

SUMMARY OF THE INVENTION

There is disclosed herein a rotating sign assembly which includes a plurality of rotatable, multi-sided, sign segments and a means for rotatably driving the plurality of sign segments. The driving means includes a drive shaft which is rotatable around a first axis of rotation and at least one output shaft which is rotatable about a second axis of rotation. The output shaft is operable to rotate one of the multi-sided sign segments. A cam is fitted to the output shaft so that it rotates about the second axis of rotation. The cam has an outer perimeter and multiple equally spaced engagement slots which extend radially inwardly from the outer perimeter of the cam. The cam also has outwardly facing stabilizing portions defined between each of the engagement slots. The cam has multiple dwell positions, each dwell position corresponding to display of one side of the multi-sided sign segment operated by the corresponding output shaft. A cam driver assembly is fitted to the drive shaft so that it rotates about the first axis of rotation. The cam driver assembly includes a cam driver which extends outwardly from the first axis of rotation and terminates in a knob. The knob describes an arc as the cam driver is rotated about the first axis of rotation. The cam driver is configured to engage one of the engagement slots of the cam when the cam is in one of the dwell positions and to rotate the cam to another dwell position as the cam driver assembly is rotated about the first axis of rotation. The cam driver assembly also includes a stabilizing member which is configured to engage one of the stabilizing portions of the cam when the cam is in a dwell position.

DETAILED DESCRIPTION OF THE PREFERRED EMBODIMENT

Figure 1:
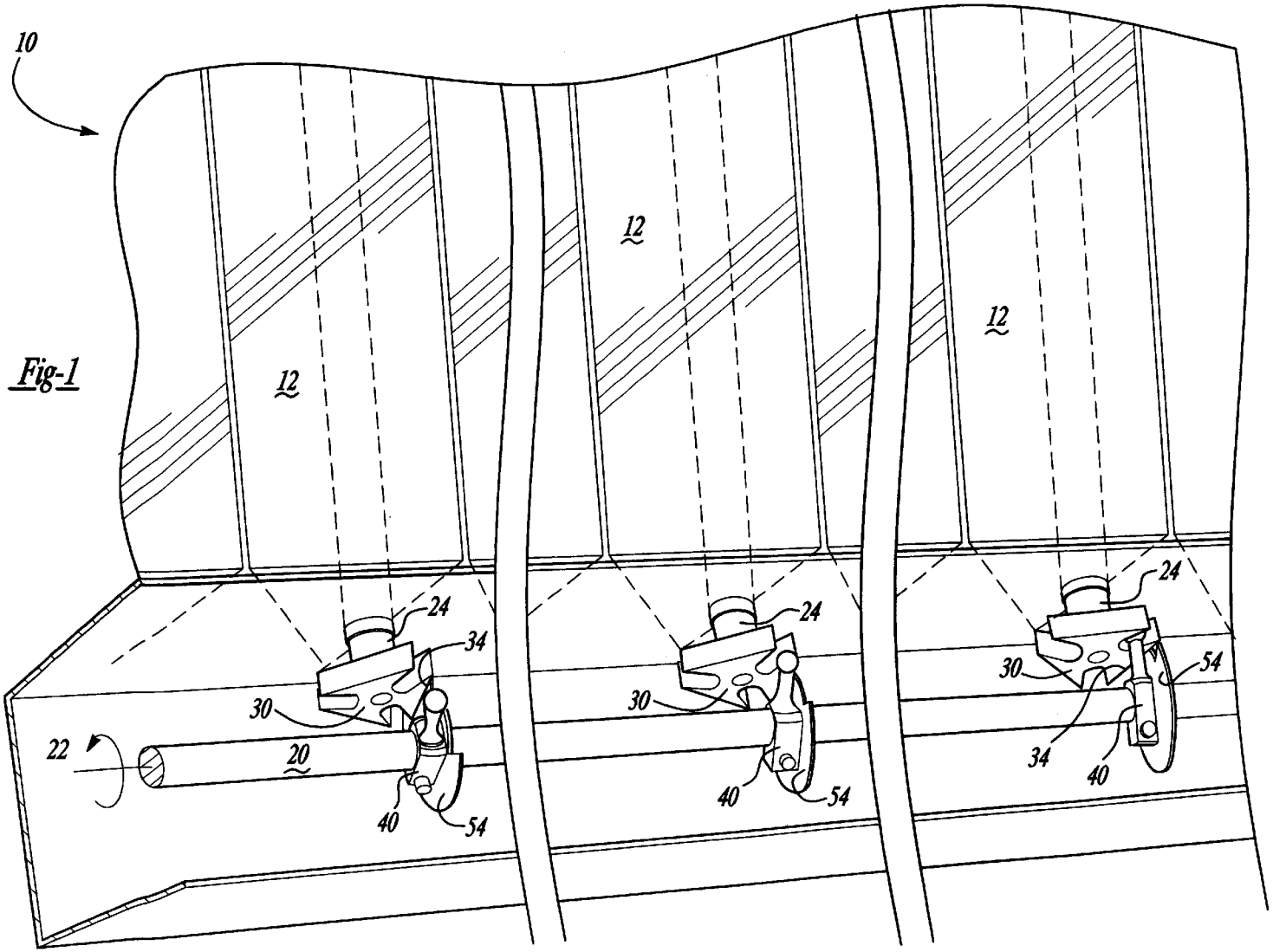
FIG. 1 is a sectioned, cut-away, perspective view of a rotating sign assembly according to the present invention.

Referring to FIG. 1, a rotating sign assembly according to the present invention is generally illustrated at 10. The rotating sign assembly 10 includes a plurality of rotatable, multi-sided, sign segments 12 arranged vertically side by side. In the preferred embodiment, each of the sign segments 12 has three sides joined together such that the sign segments 12 have a triangular cross section. Each of the three sides of the sign segments 12 are decorated with a part of an advertising image. Referring to one side of each of the sign segments 12 as a first side, an advertising image is divided into multiple segments and one segment is placed on the first side of each sign segment 12. Then, when the multiple sign segments 12 are all rotated so that the first side is aligned so as to form an essentially continuous flat surface, the complete advertising image is displayed. As can be seen, a different advertising image can be divided among the segments on each of the three sides on the sign segments 12. Then, starting with the sign segments 12 positioned so as to display the first advertising image, rotation each of the segments 120 degrees clockwise will cause the multiple sing segments 12 to once again align to display a second advertising image. Rotating the segments 12 an additional 120 degrees will display the third advertising image and rotating the segments yet again will once again display the first advertising image.

As will be clear to one of skill in the art, successful operation of the rotating sign assembly 10 requires some type of driving mechanism capable of rotating all of the sign segments 12 from one display position to another display position. The drive mechanism according to the present invention includes a drive shaft 20 which is rotatable about a first axis of rotation 22 and multiple output shafts 24 which are each rotatable about an axis of rotation which is perpendicular to the first axis of rotation 22. The drive shaft 20 is rotatably driven about the first axis of rotation 22 by a motor (not shown). The output shafts 24 each drive a corresponding one of the sign segments 12. Therefore, rotation of an output shaft 24 causes rotation of the corresponding sign segment 12. A cam 30 is fitted to each of the output shafts 24 so that rotation of the cam 30 causes rotation of the corresponding output shaft 24 which causes rotation in the corresponding sign segment 12. In FIG. 1, the cams 30 are each shown in a dwell position which corresponds to the sign segments 12 being aligned so that they display an advertising image. Each cam has three dwell positions, each dwell position corresponding to one of the three display positions of the corresponding sign segments 12.

The cams 30 are driven by cam drivers assemblies 40 which are each fitted to the drive shaft 20 for rotation about the first axis of rotation 22. One cam driver assembly 40 drives each of the cams 30.

Figure 2:
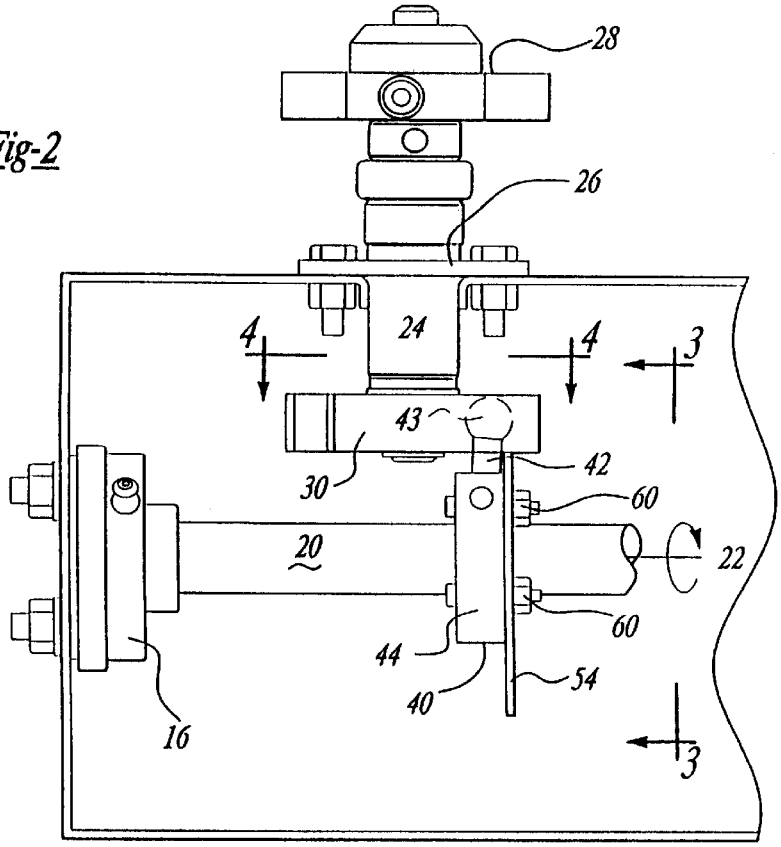
FIG. 2 is an elevational side view of a drive mechanism for one segment of a rotating sign assembly according to the present invention.
Figure 3:
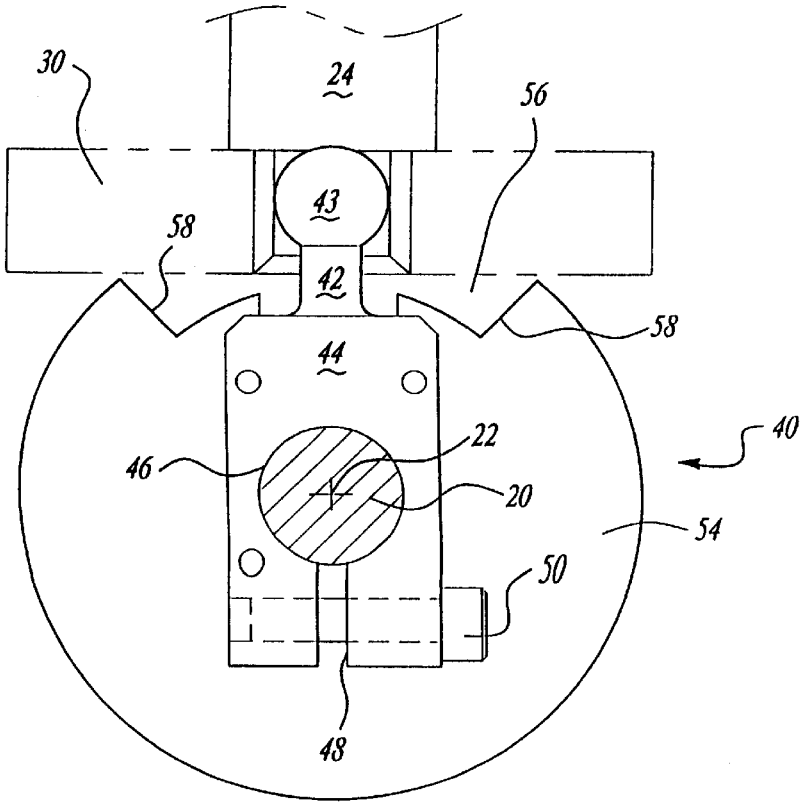
FIG. 3 is a sectional view taken along lines 3—3 of FIG. 2.
Figure 4:
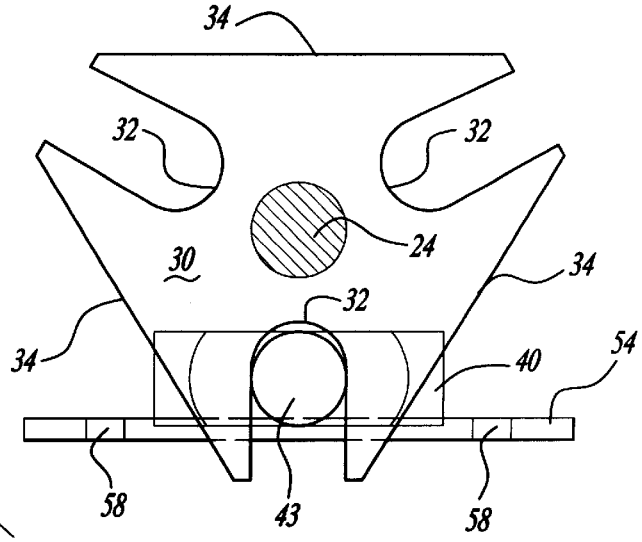
FIG. 4 is a sectional view taken along lines 4—4 of FIG. 2 showing the cam and cam driver according to the present invention.

Referring now to FIGS. 2–4, details of the drive mechanism are more easily seen. As shown in FIG. 4, the cam 30 has an outer perimeter with three equally spaced engagement slots 32 extending radially inward from the outer perimeter. Positioned between the engagement slots 32 are a total of three planar portions which act as stabilizing portions 34. The stabilizing portions 34 give the cam 30 a generally triangular shape with the engagement slots extending radially inwardly from each of the three "points" of the triangle.

As best shown in FIGS. 2 and 3, the cam driver assembly includes a cam driver 42 which extends outwardly from the first axis of rotation 22 and terminates in a knob 43. The cam driver 42 is secured to the drive shaft 20 by a base 44. The knob 43 describes an arc as the cam driver 42 is rotated about the first axis of rotation 22. The base 44 has a cylindrical bore 46 defined therethrough for accepting the drive shaft 20. Base 44 also has a slot 48 intersecting the bore 46. A bolt 50 passes through the base 44 from one side of the slot 48 to the other so that tightening the bolt causes the slot 48 to narrow thereby tightening the bore 46 and clamping it securely on the drive shaft 20. By loosening the bolt 50, the cam driver assembly 40 can be loosened on the drive shaft 20 and angularly repositioned so that the rotational position of the cam driver 42 relative to the drive shaft 20 is altered.

The cam driver assembly 40 also includes a stabilizing member, which in the preferred embodiment is a sectioned disk 54 which is bolted to the base 44 and lies perpendicular to the axis of rotation 22. The sectioned disk 54 acts as a stabilizing number by contacting one of the stabilizing portions 34 of a corresponding cam 30 when the cam is in one of its dwell positions. This arrangement locks the cam and the corresponding sign segment 12 in the proper position when the cam is not being rotated. Sectioned disk 54 has a section or relief 56 removed adjacent the cam driver 42. The relief 56 has squared off edges 58. The relief 56 allows the cam driver 42 to engage the cam 30 without interference.

Figure 5:
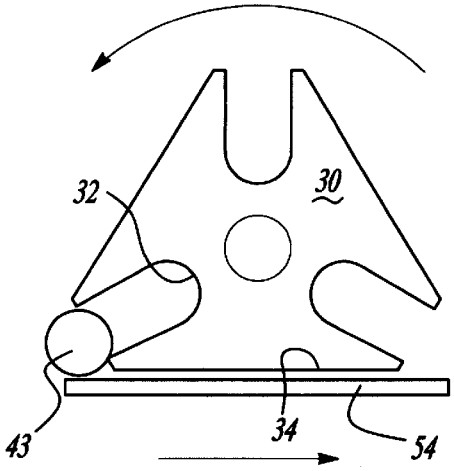
FIG. 5 is a schematic view of a cam and cam driver according to the present invention showing the cam driver initially engaging an engagement slot in the cam.
Figure 6:
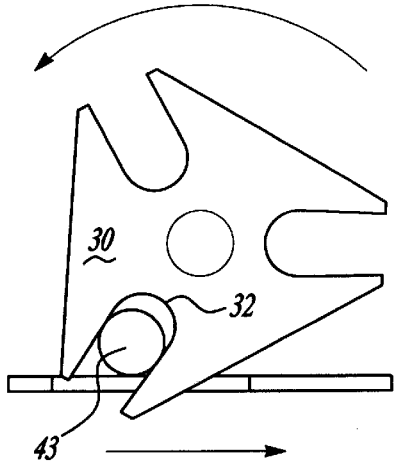
FIG. 6 is a schematic view of the cam and cam driver of FIG. 5 showing the position of the cam and cam driver shortly after they rotate from the position shown in FIG. 5.

Turning now to the operation of the drive mechanism, it can be seen in FIG. 1 that the leftmost cam 30 is in a dwell position and in this position the disk 54 is contacting one of the planar stabilizing portions 34 of the cam 30. In this position, the drive mechanism locks the cam 30 in the dwell position. Turning now to the rightmost cam 30 and cam driver assembly 40 illustrated in FIG. 1, it can be seen that this cam driver assembly 40 has rotated far enough that sectioned disk 54 no longer contacts the planar stabilizing portion 34 of the cam 30 and therefore the cam 30 can rotate. Referring to FIG. 5, the same situation is shown schematically. In this figure, the cam driver assembly 40 has reached a position in which the disk 54 is no longer in contact with the stabilizing position 34 of the cam 30. At this position, the knob 43 contacts and begins to enter one of the engagement slots 32. As the knob 43 engages the engagement slot 32, the cam 30 begins to rotate, unhindered by a sectioned disk 54. FIG. 6 shows the cam at a slightly later point than at FIG. 5. In this figure, the cam driver knob 43 is now fully engaged in the engagement slot 32 and is rotating the cam 30. Continuing with FIG. 7, the cam 30 is shown further rotated with the cam driver knob 43 completely bottomed in the slot 32. FIG. 8 shows the same cam 30 now rotated almost completely to its next dwell position. In this figure, the knob 43 is almost disengaged from the slot 32 and the edge 58 of the recess in the sectioned disk 54 is approaching one of the planar stabilizing portions 34 of the cam 30. As shown, as the cam driver assembly 40 continues to rotate, the edge 58 of the recess in the disk 54 will contact the stabilizing portion 34 of the cam 30 thereby pushing the cam 30 completely into a new dwell position. Then, as the cam driver assembly 40 continues to rotate, the sectioned disk 54 will remain in contact with the stabilizing portion 34 of the cam 30 thereby holding it in this dwell position until the cam driver once again approaches the position shown in FIG. 5. At this time, the cam 30 will again be rotated to a new dwell position.

As can be seen, the sectioned disk 54 serves two purposes. First, it acts to stabilize the cam 30 in a dwell position when the cam is not being rotated by the cam driver knob 43. Secondly, the edge 58 of the recess 56 in the sectioned disk 54 acts to push the cam 30 the last small amount into the new dwell position.

Figure 7:
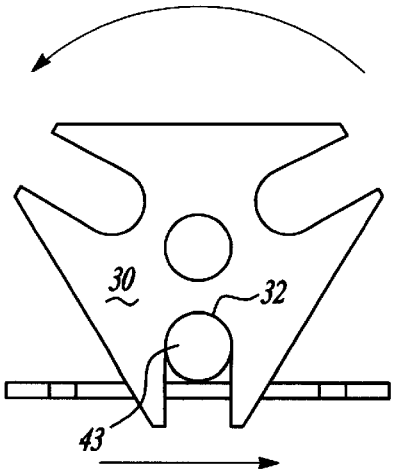
FIG. 7 is a schematic view of the cam and cam driver of FIGS. 5 and 6 shortly after they rotate from the position shown in FIG. 6.
Figure 8:
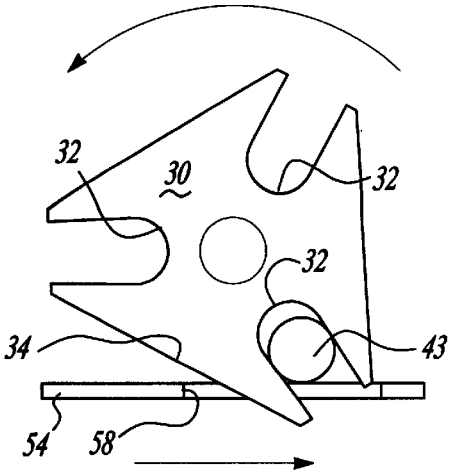
FIG. 8 is a schematic view of the cam and cam driver of FIGS. 5–7 as the cam approaches a new dwell position and the cam driver is disengaging from the cam.

As will be clear to one of skill in the art and from a study of FIGS. 5–8, the combination of the slotted cam 30 and the cam driver assembly 40 cause the cam 30 to rotate at a non-uniform speed. As the knob 43 first engages the slot 32 in the cam 30, as shown in FIG. 5, the cam 30 rotates very slowly. However, as the cam 30 reaches the halfway point to its next dwell position, as shown in FIG. 7, the cam 30 will be rotating much faster. Then, as the cam 30 approaches its new dwell position, the speed of rotation will once again slow as the knob 43 moves down the engagement slot and exits as shown in FIG. 8. The cam driver knob 43 moves at a constant rotational speed while rotating the cam but the cam rotates slowly at first, accelerating to a maximum speed near the center point of its rotation, and slowing back down and finally coming to a stop in its new dwell position. The variation in rotational speed is due to the geometry of the cam 30 and the relative positioning of the cam driver assembly 40 and the cam 30. This non-uniform rate of rotation is highly desirable for a rotating sign assembly having a plurality of rotatable multisided sign segments 12. In a billboard size rotating sign assembly 10, the individual sign segments 12 are heavy and require a significant amount of force to rotate them from one display position to the next. Therefore, the stresses in the drive mechanism are reduced by rotating the sign segment slowly at first, accelerating, decelerating, and finally finishing the rotation slowly. While the stresses could also be reduced by performing an entire rotation at a slow speed, this would cause the sign segments to remain between display positions for an increased period of time which is undesirable for aesthetic reasons.

Referring to FIG. 2, other aspects of the drive mechanism can be seen. The drive shaft 20 is supported by a bearing 16 at one of its ends. As will be clear to one of skill in the art, the drive shaft may be supported, and driven, in any of a number of ways. The output shaft 24 is supported by a bracket and bearing assembly 26. This bearing and support assembly 26 may be of many designs as will be clear to those of skill in the art. The upper end of the output shaft 24 is a bracket 28 which serves to interface with one of the sign segments 12. Depending on the design of the rotating sign, the sign segments may have various designs and require various types of interfaces. However, the present invention may be made to work with any of these rotating sign segments by modifying the bracket 28.

Referring back to FIG. 1, it can be seen that the three illustrated cam driver assemblies 40 are not positioned in the same rotational position with respect to the drive shaft 20. This is not only desirable, but is a feature of the present invention. As described earlier, the cam driver assemblies 40 are adjustably positioned on the drive shaft 20 and can be positioned such that their rotational position relative to the drive shaft 20 is all the same or different from one another. It has been found that sequentially rotating the various sign segments 12 can give a highly pleasing effect. For example, rotation of the sign segments 12 near the center of a billboard rotate slightly before their neighboring sign segments, causes the change from one advertising message to the next to appear to sweep from the center of the rotating sign 10 to the sides much like the opening of a curtain. This is accomplished by rotationally positioning the cam driver assemblies 40 such that the cam driver assemblies near the center of the rotating sign 10 engage their corresponding cams 30 prior to the cam driver assemblies further from the center of the sign. Each cam driver is offset slightly from the cam driver next to it so that rotation of the sign segments 12 flow smoothly from the center to the sides of the sign 10. An alternative effect can be achieved by positioning the cam driver assemblies such that a change from one advertising display to the next appears to sweep from one side of the sign to the other. The appearance of the change sweeping from a portion of the sign to the other is especially desirable where all three of the advertising displays are somehow related. In this way, the displays can be made to flow into one another enhancing their effect. While the sequential rotation effect is highly desirable for some applications, other applications may not benefit from the effect or the effect may be distracting or otherwise undesired by the advertiser. Therefore, it is highly desirable that the rotational positions of the cam driver assemblies 40 be adjustable so that the same rotating sign 10 can be changed from a standard setup where all segments rotate at the same time to a set up which gives a sweeping affect. Prior approaches to providing sequential rotation of sign segments did not allow for adjustment. However, the present invention can be easily adjusted after or when the sign is installed.

The drive shaft 20 may be rotated at a constant speed without stop or it may be started and stopped as necessary. If the drive shaft 20 is rotated at a constant speed, the amount of time one message is displayed and the speed at which the segments 12 are rotated will be directly related to each other. Unlike with prior art signs, where stopping the sign segments 12 at a display position meant stopping the drive shaft 20 in a specific position, the present invention allows the drive shaft 20 to be rotated at a constant rpm therefore avoiding complications associated with starting and stopping the drive motor. However, if it is desired that the time which each display is left in the display position be increased, the drive shaft 20 can be stopped following each rotation allowing the advertising display to remain visible for a longer period of time. The drive shaft 20 may also be reversed between clockwise and counterclockwise rotation if desired. This may be useful where only two advertising displays on a three sided signs are to be displayed such as when one of the advertisers has not yet paid for their side of the sign. Unlike prior art designs where the drive shaft must be stopped in a precise position to allow display of one of the advertising displays, in the present invention, the drive shaft 20 can be stopped in a variety of positions so long as the cam driver assemblies 40 do not have their knobs 43 engaging the cams 30. This leaves a wide range in which the drive shaft 20 may be stopped which reduces the cost and complexity of the control devices necessary for a drive motor.

In view of the teaching presented herein, other modifications and variations of the present invention will be readily apparent to those of skill in the art. The foregoing drawings, discussion, and description are illustrated of some embodiments of the present invention but are not meant to be limitations on the practice thereof and it is the following claims, including all equivalents which define the scope of the invention.

I claim:

1. A rotating sign assembly comprising:

a plurality of rotatable, three-sided, sign segments; and means for rotatably driving said plurality of sign segments, said driving means comprising:

a drive shaft rotatable about a first axis of rotation;

a first output shaft rotatable about a second axis of rotation, wherein said first axis of rotation is perpendicular to said second axis of rotation, said output shaft operable to rotate one of said three-sided sign segments;

a first cam fitted to said first output shaft for rotation about the second axis of rotation, said cam having an outer perimeter and three equally spaced engagement slots extending radially inwardly from said outer perimeter, said cam further comprising an outwardly facing stabilizing portion defined between each of said slots, said cam having a plurality of dwell positions each corresponding to display of one side of the three-sided sign segments operated by said first output shaft;

a first cam driver assembly fitted to said drive shaft for rotation about the first axis of rotation comprising a first cam driver extending outwardly from the first axis of rotation and terminating in a knob, said knob describing an arc as said first cam driver is rotated about the first axis of rotation, said cam driver configured to engage one of said engagement slots when said first cam is in a dwell position and rotate said cam to another dwell position as said cam driver assembly is rotated about the first axis of rotation, said first cam driver assembly further comprising a stabilizing member configured to engage one of said stabilizing portions when said cam is in a dwell position.

2. The rotating sign assembly of claim 1, wherein said stabilizing member comprises a sectioned disk occupying a plane perpendicular to the first axis of rotation, said sectioned disk having a relief removed adjacent said cam driver knob.

3. The rotating sign assembly of claim 1, wherein said cam driver assembly further comprises a clamp, said clamp allowing the angular adjustment of said cam driver assembly on said drive shaft so that a rotational position of said cam driver relative to said drive shaft can be adjusted.

4. A rotating sign assembly comprising:

a plurality of rotatable, multi-sided, sign segments; and means for rotatably driving said plurality of sign segments, said driving means comprising:

a drive shaft rotatable about a first axis of rotation;

a plurality of output shafts each rotatable about their own axis of rotation, each output shaft operable to rotate one of said multi-sided sign segments;

a cam fitted to each of said output shafts for rotation about the axis of rotation of said output shaft, each cam having an outer perimeter and a plurality of equally spaced engagement slots extending radially inwardly from said outer perimeter, each cam further comprising an outwardly facing stabilizing portion defined between each of said slots, each cam having a plurality of dwell positions each corresponding to display of one side of the corresponding multi-sided sign segment operated by the corresponding output shaft;

a plurality of cam driver assemblies fitted to said drive shaft for rotation about the first axis of rotation, each comprising a cam driver extending outwardly from the first axis of rotation and terminating in a knob, each knob describing an arc as said cam drivers are rotated about the first axis of rotation, one cam driver corresponding to each cam and configured to engage one of said engagement slots when said cam is in a dwell position and rotate said cam to another dwell position as said cam driver assemblies are rotated about the first axis of rotation, each cam driver further comprising a stabilizing member configured to engage one of said stabilizing portions of the corresponding cam when said cam is in a dwell position.

5. The rotating sign assembly of claim 4, wherein said plurality of cam driver assemblies further comprise a clamp disposed on each cam driver assembly, said clamp allowing the angular adjustment of cam driver assemblies on said drive shaft so that the rotational position of each of said cam driver assemblies relative to said drive shaft can be adjusted.

6. The rotating sign assembly of claim 5, wherein each of said plurality of cam drivers are fitted to said drive shaft such that said multi-sided, sign segments rotate substantially in unison.

7. The rotating sign assembly of claim 5, wherein each of said plurality of cam drivers are fitted to said drive shaft such that said multi-sided, sign segments rotate in sequence.

8. The rotating sign assembly of claim 7, where said plurality of cam drivers are fitted to said output shaft such that a first predetermined number of said plurality of multi-sided, sign segments are rotated followed by the rotation a second predetermined number of multi-sided, sign segments.

9. A rotating sign assembly comprising:

a plurality of rotatable, multi-sided, sign segments; and means for rotatably driving said plurality of sign segments, said driving means comprising:

a drive shaft rotatable about a first axis of rotation;

a first output shaft rotatable about a second axis of rotation, said output shaft operable to rotate one of said multi-sided sign segments;

a first cam fitted to said first output shaft for rotation about the second axis of rotation, said cam having an outer perimeter and a plurality of equally spaced engagement slots extending radially inwardly from said outer perimeter, said cam further comprising an outwardly facing stabilizing portion defined between each of said slots, said cam having a plurality of dwell positions each corresponding to display of one side of the multi-sided sign segments operated by said first output shaft;

a first cam driver assembly fitted to said drive shaft for rotation about the first axis of rotation comprising a first cam driver extending outwardly from the first axis of rotation and terminating in a knob, said knob describing an arc as said first cam driver is rotated about the first axis of rotation, said cam driver configured to engage one of said engagement slots when said first cam is in a dwell position and rotate said cam to another dwell position as said cam driver assembly is rotated about the first axis of rotation, said first cam driver assembly further comprising a stabilizing member having a planar surface configured to engage one of said stabilizing portions when said cam is in a dwell position.

10. A rotating sign assembly comprising:

a plurality of rotatable, multi-sided, sign segments; and means for rotatably driving said plurality of sign segments, said driving means comprising:

a drive shaft rotatable about a first axis of rotation;

a first output shaft rotatable about a second axis of rotation, said output shaft operable to rotate one of said multi-sided sign segments;

a first cam fitted to said first output shaft for rotation about the second axis of rotation, said cam having an outer perimeter and a plurality of equally spaced engagement slots extending radially inwardly from said outer perimeter, said cam further comprising an outwardly facing stabilizing portion defined between each of said slots, said cam having a plurality of dwell positions each corresponding to display of one side of the multi-sided sign segments operated by said first output shaft;

a first cam driver assembly fitted to said drive shaft for rotation about the first axis of rotation comprising a first cam driver extending outwardly from the first axis of rotation and terminating in a knob, said knob describing an arc as said first cam driver is rotated about the first axis of rotation, said cam driver configured to engage one of said engagement slots when said first cam is in a dwell position and rotate said cam to another dwell position as said cam driver assembly is rotated about the first axis of rotation, said first cam driver assembly further comprising a stabilizing member configured to engage one of said stabilizing portions when said cam is in a dwell position;

a second output shaft rotatable about a third axis of rotation, said output shaft operable to rotate a second one of said multi-sided sign segments;

a second cam fitted to said second output shaft for rotation about the third axis of rotation, said cam having an outer perimeter and a plurality of equally spaced engagement slots extending radially inwardly from said outer perimeter, said cam further comprising an outwardly facing stabilizing portion defined between each of said slots, said cam having a plurality of dwell positions each corresponding to display of one side of the multi-sided sign segment operated by said second output shaft;

a second cam driver assembly fitted to said drive shaft for rotation about the first axis of rotation comprising a second cam driver extending outwardly from the first axis of rotation and terminating in a knob, said knob describing an arc as said second cam driver is rotated about the first axis of rotation, said cam driver configured to engage one of said engagement slots when said second cam is in a dwell position and rotate said cam to another dwell position as said cam driver assembly is rotated about the first axis of rotation, said second cam driver further comprising a stabilizing member configured to engage one of said stabilizing portions when said cam is in a dwell position.

11. The rotating sign assembly of claim 10, wherein said first and said second cam driver assemblies further comprise a first and a second camp, said first and second clamp allowing the angular adjustment of said first and second cam driver assemblies on said drive shaft so that a rotational position of each of said cam drivers relative to said drive shaft can be adjusted.

12. The rotating sign assembly of claim 11 wherein said first cam driver is mounted to said drive shaft such that said rotational position of said first cam driver is the same as said rotational position of said second cam driver so that said first and second cars are engaged and rotated at the same time.

13. The rotating sign assembly of claim, 11 wherein said first cam driver is mounted to said drive shaft such that rotational position of said first cam driver is offset from said rotational position of said second cam driver so that said first cam driver engages said first cam before said second cam driver engages said second cam as said drive shaft is rotated about said first axis of rotation.

14. A rotating sign assembly comprising:

a plurality of rotatable, three-sided, sign segments; and means for rotatably driving said plurality of sign segments, said driving means comprising:

a drive shaft rotatable about a first axis of rotation;

a first output shaft rotatable about a second axis of rotation, wherein said first axis of rotation is perpendicular to said second axis of rotation, said output shaft operable to rotate one of said three-sided sign segments;

a first cam fitted to said first output shaft for rotation about the second axis of rotation, said cam having an outer perimeter and three equally spaced engagement slots extending radially inwardly from said outer perimeter, said cam further comprising an outwardly facing stabilizing portion defined between each of said slots, said cam having a plurality of dwell positions each corresponding to display of one side of the multi-sided three-sided sign segments operated by said first output shaft;

a first cam driver assembly fitted to said drive shaft for rotation about the first axis of rotation comprising a first cam driver extending outwardly, said first cam driver describing an arc as it is rotated about the first axis of rotation, said cam driver configured to engage one of said engagement slots when said first cam is in a dwell position and rotate said cam to another dwell position as said cam driver assembly is rotated about the first axis of rotation, said first cam driver assembly further comprising a stabilizing member configured to engage one of said stabilizing portions when said cam is in a dwell position.

15. A rotating sign assembly comprising:

a plurality of rotatable, multi-sided, sign segments; and means for rotatably driving said plurality of sign segments, said driving means comprising:

a drive shaft rotatable about a first axis of rotation;

a first output shaft rotatable about a second axis of rotation, said output shaft operable to rotate one of said multi-sided sign segments;

a first cam fitted to said first output shaft for rotation about the second axis of rotation, said cam having an outer perimeter and a plurality of equally spaced engagement slots extending radially inwardly from said outer perimeter, said cam further comprising an outwardly facing stabilizing portion defined between each of said slots, said cam having a plurality of dwell positions each corresponding to display of one side of the multi-sided sign segments operated by said first output shaft;

a first cam driver assembly fitted to said drive shaft for rotation about the first axis of rotation comprising a first cam driver extending outwardly, said first cam driver describing an arc as it is rotated about the first axis of rotation, said cam driver configured to engage one of said engagement slots when said first cam is in a dwell position and rotate said cam to another dwell position as said cam driver assembly is rotated about the first axis of rotation, said first cam driver assembly further comprising a stabilizing member having a planar surface configured to engage one of said stabilizing portions when said cam is in a dwell position.

* * * * *

UNITED STATES PATENT AND TRADEMARK OFFICE

CERTIFICATE OF CORRECTION

PATENT NO. : 6,128,841
DATED : October 10, 2000
INVENTOR(S) : Paul H. Werner

It is certified that error appears in the above-identified patent and that said Letters Patent is hereby corrected as shown below:

Column 9,
Line 53, replace "cars" with -- cams --.

Signed and Sealed this

Thirtieth Day of October, 2001

*Attest:*

Nicholas P. Godici

NICHOLAS P. GODICI
*Acting Director of the United States Patent and Trademark Office*

*Attesting Officer*